US005435022A

United States Patent [19]

Andersen

[11] Patent Number: 5,435,022

[45] Date of Patent: Jul. 25, 1995

[54] SECONDARY SINK

[76] Inventor: Ib V. Andersen, 8584 - 145A St., Surrey, B.C., Canada, V3S 2Z2

[21] Appl. No.: 235,420

[22] Filed: Apr. 22, 1994

[51] Int. Cl.[6] ..... E03C 1/01

[52] U.S. Cl. ..... 4/641

[58] Field of Search ..... 4/640, 641, 642, 643, 4/653

[56] References Cited

U.S. PATENT DOCUMENTS

| | | | |
|---|---|---|---|
| 912,086 | 2/1909 | De Lory | 4/641 |
| 1,102,411 | 7/1914 | James | 4/641 X |
| 1,370,088 | 3/1921 | Chervin | 4/641 X |
| 1,842,289 | 1/1932 | Russel | 4/641 |
| 2,561,836 | 7/1951 | Anderson | 4/653 X |
| 3,594,825 | 7/1971 | Reid | 4/2 |
| 5,073,997 | 12/1991 | Lathi | 4/629 |
| 5,136,736 | 8/1992 | Bishop | 4/641 |
| 5,165,456 | 11/1992 | Woolman | 141/98 |
| 5,228,152 | 7/1993 | Fraley | 4/664 |

FOREIGN PATENT DOCUMENTS

| | | | |
|---|---|---|---|
| 89107088 | 7/1991 | China . | |
| 0472885A2 | 7/1991 | European Pat. Off. . | |
| 0021582 | 7/1961 | German Dem. Rep. | 4/642 |

*Primary Examiner*—Charles E. Phillips
*Attorney, Agent, or Firm*—Norman M. Cameron

[57] ABSTRACT

A water saving apparatus includes a bowl-like container having a open top, a bottom, a front and a back. The top of the container slopes downwardly from the front to the back thereof. The container has a pedestal on the bottom thereof and a drain hole in the bottom extending through the pedestal. A drain pipe extends from the drain hole. There is a fitting for compressing the pedestal against a flat surface. The container may be flexible, having a suction cup-like pedestal.

15 Claims, 3 Drawing Sheets

SECONDARY SINK

BACKGROUND OF THE INVENTION

This invention relates to apparatuses for saving water normally wasted and, in particular, to secondary sinks for receiving water normally wasted when a faucet is run prior to filling a container with drinking water.

It is recognized that a large amount of water is wasted in the average household and this contributes to the strain on water resources, particularly in water short areas. One example is the loss of potable water down the drain as the faucet is run prior to filling a glass or other container with drinking water.

Many different apparatuses have been developed in the past for purposes of saving water. For example, U.S. Pat. No. 3,594,825 discloses a water circulation system for a trailer or boat where water from the shower or basin is directed to a flush toilet. U.S. Pat. No. 5,228,152 to Fraley shows a water saving toilet and bathroom fixture system. There is a sink mounted to a fixture base above the toilet tank. Water from the sink is diverted into the tank.

U.S. Pat. No. 5,165,456 to Woolman shows a diverter apparatus for saving fresh water wasted when the water is run prior to obtaining hot water for a shower or the like. A valve is used to accomplish this function.

Chinese Patent 89107088 shows how water from a water-saving pool goes to a separate reservoir for washing mops of the like.

U.S. Pat. No. 5,073,997 shows a built-in sink including a garbage chute. The chute is intended for solid waste.

However, the prior art does not reveal a simple inexpensive device which can be readily mounted on or adjacent existing sinks at which is capable of receiving and saving potable water normally lost down the sewer from the sink.

SUMMARY OF THE INVENTION

It is an object of the invention to provide an improved water saving apparatus capable of being easily mounted adjacent or within existing sinks and which can receive and save water normally lost down the sink.

It is also an object of the invention to provide an improved water saving apparatus which can be attached to a closed container by a drain and readily sealed against an existing sink or counter.

It is a further object of the invention to provide an improved water saving apparatus which is low in cost compared with the potential water saved.

It is a still further object of the invention to provide an improved water saving apparatus which is rugged and reliable to use.

In accordance with these objects, there is provided a water saving apparatus comprising a container having a bowl with an open top, a bottom, a front and a back and which slopes downwardly from the front to the back thereof. The container has a pedestal on the bottom thereof and a drain hole in the bottom extending through the pedestal. A drain pipe extends from the drain hole. There is means for compressingly fitting the pedestal against the flat surface.

Preferably the pedestal extends outwardly beyond the front, the back and the sides of the base of the container.

The invention also provides an apparatus for saving water which includes a sink with a pivotable faucet mounted adjacent the sink. There is a bowl-like container positioned within reach of the faucet to divert water from the sink. A closed storage tank is connected to the container by a drain. The container may be mounted in the sink or on a counter adjacent to the sink.

DESCRIPTION OF THE PREFERRED EMBODIMENTS

Figure 1:
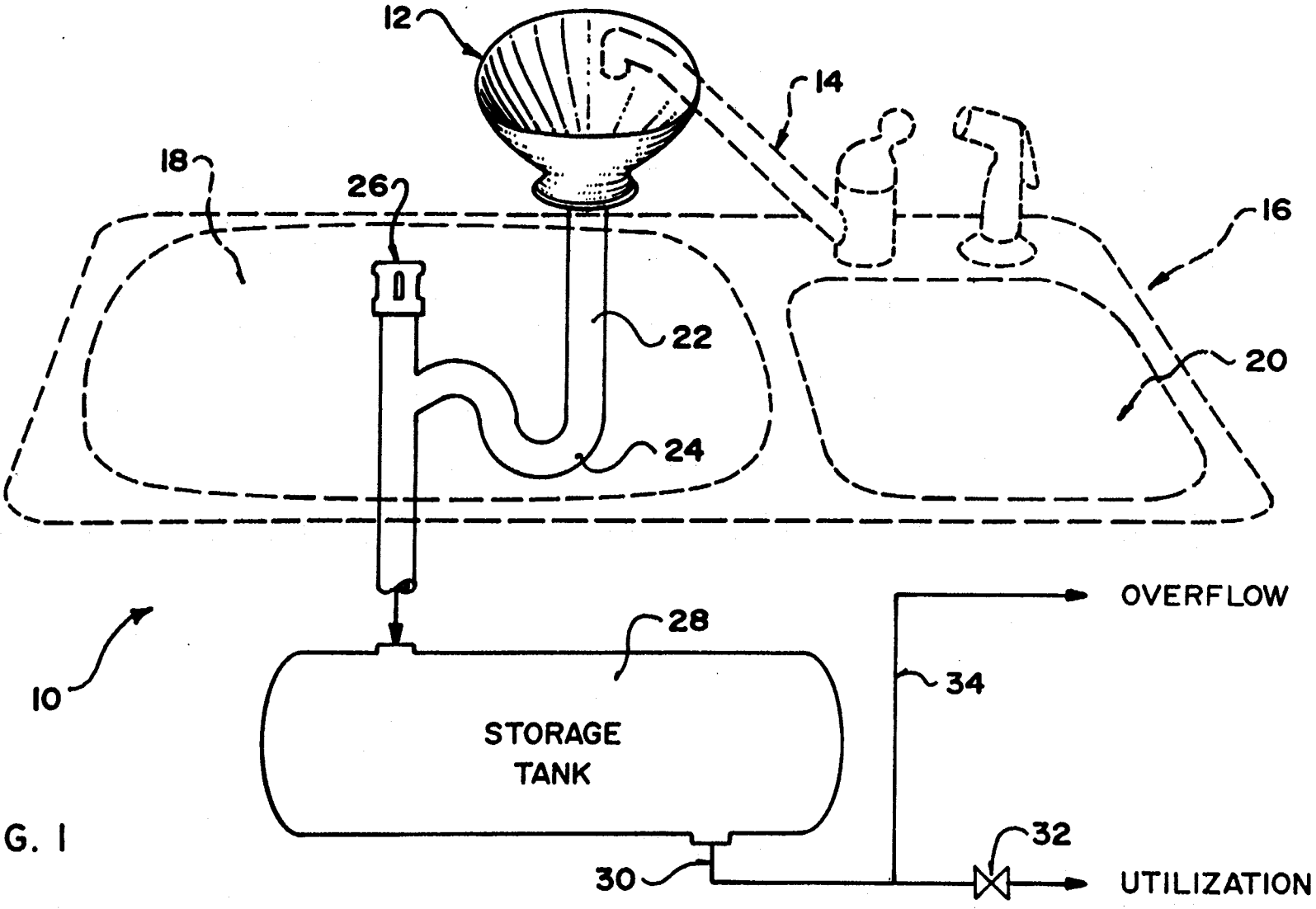
FIG. 1 is a perspective, partly schematic view of an apparatus for saving water including a sink and a faucet shown in broken lines, a container for receiving fresh water normally lost down the sink, a storage tank and a drain connecting the container to the storage tank.

Referring to the drawings, FIG. 1 shows a water saving apparatus 10 including a container 12 positioned within reach of a pivotable faucet 14 mounted adjacent a conventional sink 16. In this example the sink 16 has two portions 18 and 20, but the invention is applicable to all types of sinks. Also in this example the faucet is mounted on the sink although alternatively the faucet could be mounted on the counter adjacent to the sink. The container 12 is connected to a drain 22 equipped with a conventional trap 24 and a stackless vent 26. Such vents are known and are, for example, sold under the trade mark Pro Vent.

The drain is connected to a closed storage tank 28 which has a drain 30 fitted with a valve 32 and an overflow line 34 on the drain.

Figure 2:
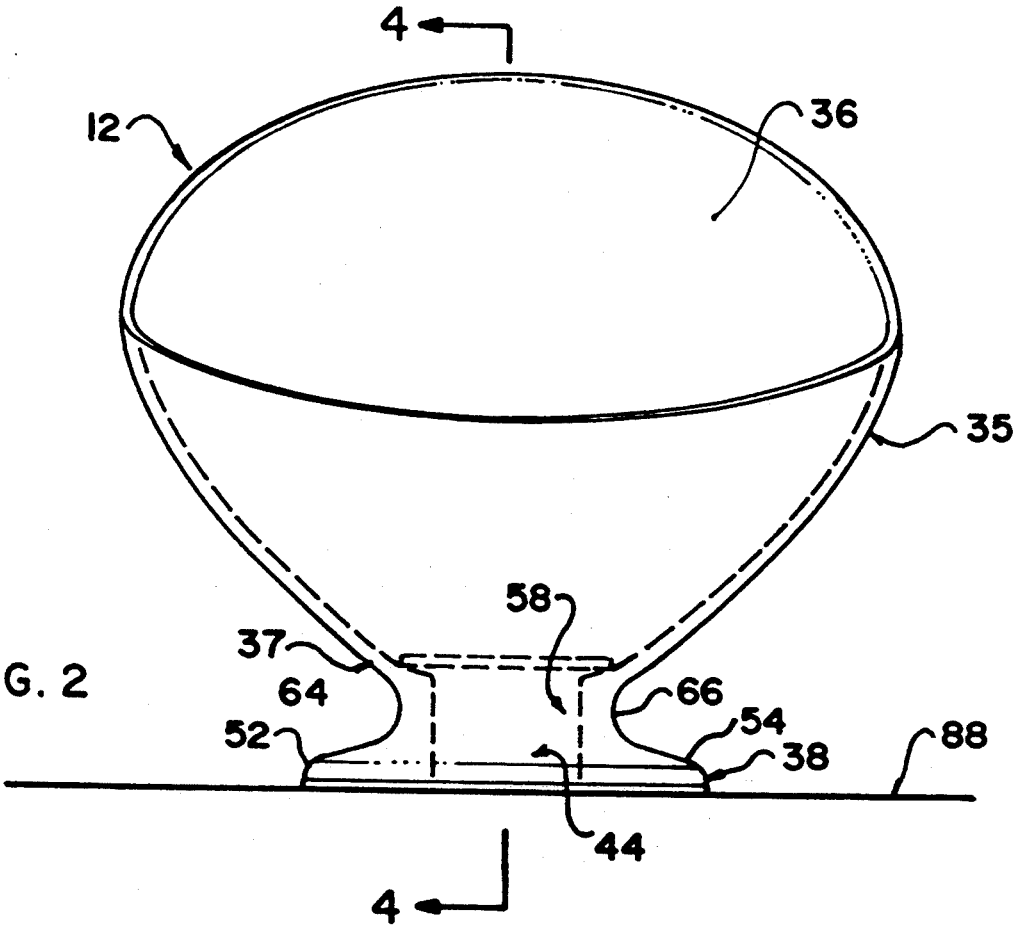
FIG. 2 is a front elevation of the container.
Figure 3:
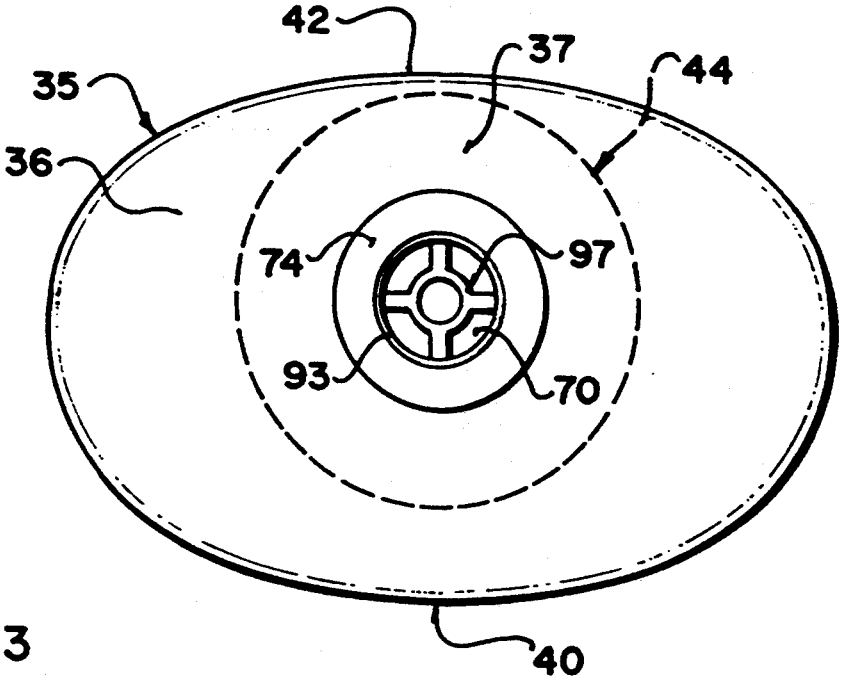
FIG. 3 is a top plan of the container.
Figure 4:
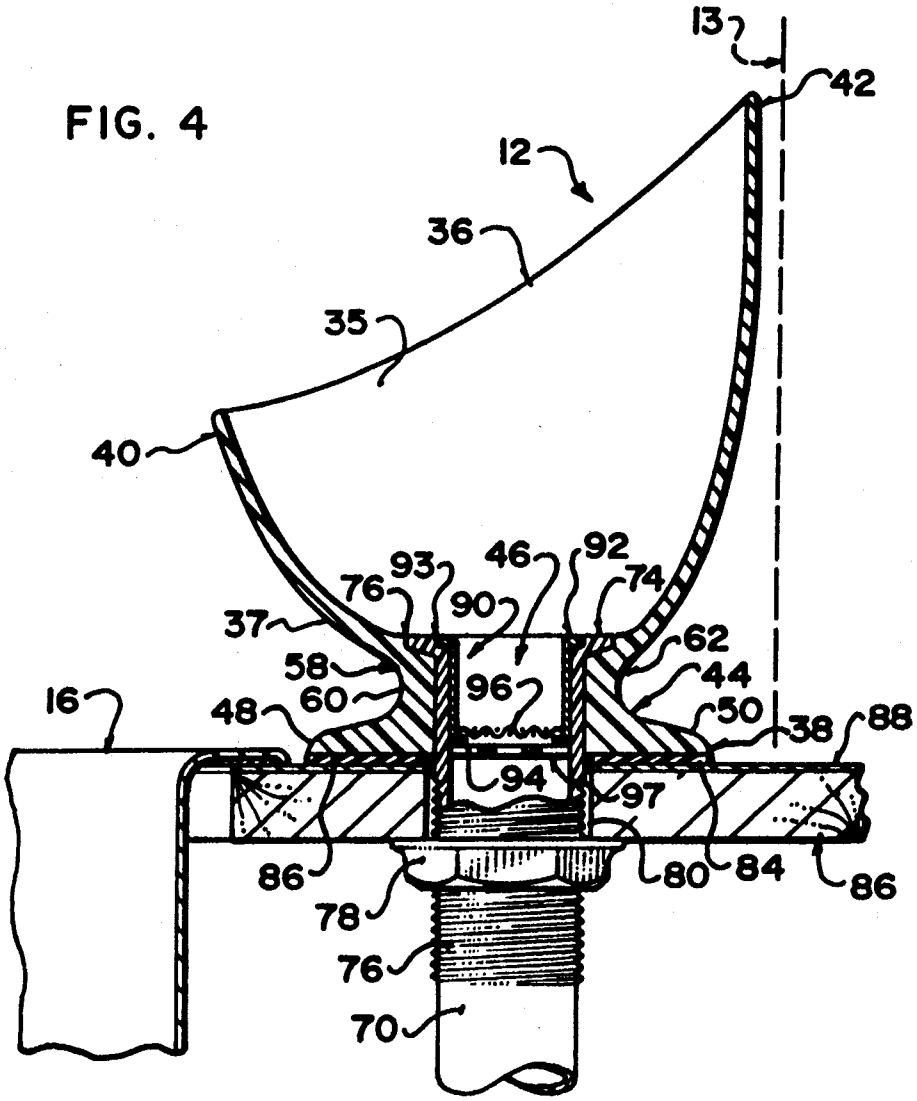
FIG. 4 is a sectional view taken along line 4—4 of FIG. 2, showing the container mounted on a counter.

Referring to container 12 in more detail, FIGS. 2–4 illustrate that the container has a bowl 35 having an open top 36, a bottom 37, a front 40 and a back 42. The container slopes downwardly at the top thereof from the back to the front as best seen in FIG. 4. This shape tends to conserve more water because the high back catches water splashed by the faucet.

The container in this embodiment has a pedestal 44 at the bottom 38 of the container 12. There is a drain hole 46 in the bottom of the container which extends through the pedestal. In this embodiment the pedestal has a front 48, a back 50 and sides 52 and 54.

The bowl 35 has a base 58 at bottom 37 above the pedestal having a front 60, a back 62 and sides 64 and 66. It may be seen in FIGS. 2 and 4 that the front, back and sides of the pedestal extend outwardly beyond the front, back and sides of the base in this example.

There is a drain pipe 70 extending from the drain hole 46 downwardly from the container. The drain pipe has a top 72 provided with an exterior flange 74. There is an annular recess 76 inside the container extending about the drain hole 46 which closely receives the flange 74.

The drain pipe 70 has exterior male threads 76, as shown best in FIG. 4, equipped with a nut 78. In this example the drain pipe extends through an aperture 80 in a convention kitchen counter 82 adjacent to sink 16. A gasket 84, of rubber or a similar elastomeric substance, is fitted between bottom 86 of the pedestal, which is flat in this example, and the top 88 of counter 82. The nut and gasket serves as means for compressingly fitting the pedestal against the fiat surface formed by the top of the counter.

There is a sleeve 90 received within the top of the drain pipe 70. The sleeve has an exterior flange 92 at the top thereof received within a corresponding annular 93 at the top of the drain pipe. The sleeve has an interior flange 94 at the bottom thereof. A screen 96 is fitted on top of the flange 94 and served to keep solids from going down the drain pipe into the storage tank.

Figure 5:
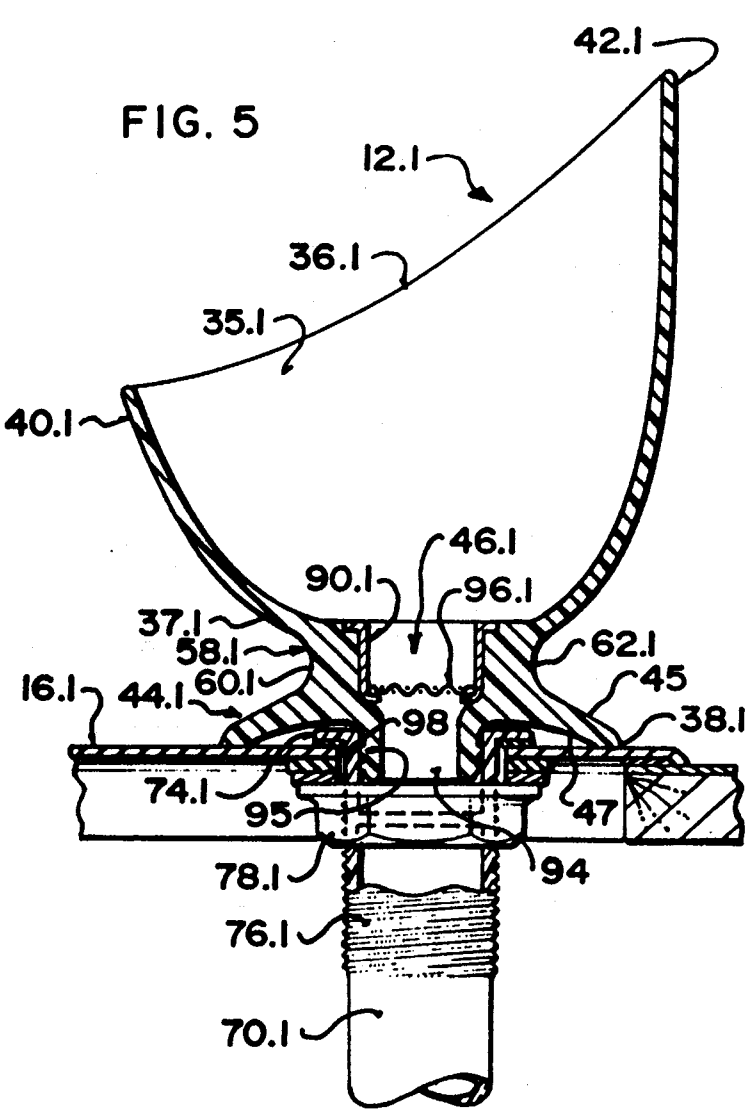
FIG. 5 is a view similar to FIG. 4 showing an alternative embodiment of the invention made of a flexible material and mounted on a sink.

FIG. 5 shows a container 12.1 according to another embodiment of the invention. The container is generally similar and like numbers are used for like parts with the additional designation ".1". Whereas container 12 is made of a rigid material, such as rigid plastic, container 12.1 is made of a flexible material such as a softer, flexible plastic. Such a material may be preferred for a number of reasons. For one thing, there is less likely to be breakage of glasses or the like if they accidentally hit the container, particularly when used by children. For another thing, this allows the container to be sealingly mounted without the need of a separate gasket as in the previous embodiment.

In this example a pedestal 44.1 has a convex top 45 and a concave bottom 47. This allows the pedestal to function in a suction cup-like manner to seal the container against the fiat surface, in this case directly on the sink 16.1. However this embodiment could also be mounted on the counter as with the previous embodiment.

The container has an annular projection 94 on the bottom thereof extending about drain hole 46.1 and away from the pedestal 44.1. The projection has means for releasably connecting the container to drain pipe 70.1. In this instance the means includes a series of spaced-apart annular ridges 95 extending about the projection 94.

In this example the drain pipe 70.1 has its annular flange 74.1 mounted on the sink 16.1 about opening 98 there through. The nut 78.1 compresses the flange against the top of the sink with the gasket therebetween. The container is pushed downwardly with the projection 92 inside the drain pipe until the container is held tightly in place.

In this example the sleeve 90.1 with its screen 96.1 are fitted directly into a corresponding shaped recess about drain hole 46.1 in the container instead of being fitted within the drain pipe as in the previous embodiment.

It will be understood by someone skilled in the art that many of the details described above are by way of example only and can be deleted or varied without departing from the scope of the invention which is to be interpreted with reference to the following claims.

What is claimed is:

1. A water saving apparatus, comprising:

a bowl-like, flexible container having an open top, a bottom, a front and a back, the top sloping downwardly from the front to the back thereof, the container having a bowl with a base having a front, a back and sides, a pedestal on the bottom thereof, the pedestal extending outwardly beyond the front, the back and the sides of the base and having a convex top and a concave bottom, and a drain hole in the bottom extending through the pedestal, the container having an annular projection on the bottom thereof about the drain hole and extending away from the pedestal;

a drain pipe extending from the drain hole;

means for releasably connecting the container to the drain pipe; and means for compressingly fitting the pedestal against a flat surface.

2. An apparatus as claimed in claim 1, wherein the drain pipe has exterior threads, the means for compressingly fitting being a nut received on the threads of the drain pipe.

3. An apparatus as claimed in claim 2, wherein the drain pipe has a top with a flange thereon, the container having a recess about the drain hole which closely receives the flange.

4. An apparatus as claimed in claim 3, wherein the drain pipe has a sleeve therein which extends downwardly from the flange, the sleeve having a screen mounted therein.

5. An apparatus as claimed in claim 2, wherein the pedestal has a bottom, the means including a gasket on the bottom of the pedestal about the drain pipe.

6. An apparatus as claimed in claim 5, wherein the bottom of the pedestal is flat.

7. An apparatus as claimed in claim 1, wherein the means for connecting is a plurality of spaced-apart angular ridges about the projection.

8. An apparatus as claimed in claim 7, wherein the drain pipe has a top with a flange received adjacent the bottom of the pedestal, exterior threads and a nut received on the threads.

9. An apparatus as claimed in claim 8, wherein the container has an inside with a recess extending about the drain hole, a sleeve extending within the recess and a screen extending across the sleeve.

10. An apparatus for saving water, comprising:

a sink;

a pivotable faucet mounted adjacent the sink;

a bowl-like, flexible container positioned within reach of said faucet to divert water from the sink, the container having an open top, a bottom, a front and a back, the top sloping downwardly from the front to the back thereof, the container having a pedestal on the bottom thereof, a drain hole in the bottom extending through the pedestal, a base with a front, a back and sides, the pedestal extending outwardly beyond the front, the back and the sides of the base, the pedestal having a convex top and a concave bottom, the container having an annular projection on the bottom thereof about the drain hole and extending away from the pedestal; a closed storage tank;

a drain connecting the storage tank to the container; and means for releasably connecting the container to the drain.

11. An apparatus as claimed in claim 10, wherein the container is mounted on the sink.

12. An apparatus as claimed in claim 10, wherein the container is mounted on a counter adjacent to the sink.

13. An apparatus as claimed in claim 12, wherein the drain has a stackless vent thereon.

14. An apparatus as claimed in claim 12, wherein the tank has a tank drain connected thereto.

15. An apparatus as claimed in claim 14, wherein the drain has an overflow conduit connected thereto.

* * * * *